US010302391B1

(12) United States Patent
Akar

(10) Patent No.: US 10,302,391 B1
(45) Date of Patent: May 28, 2019

(54) HOLSTER

(71) Applicant: AKAR SARACIYE AV MALZEMELERI IMALAT ITHALAT IHRACAT SAN. VE TIC. LTD. STI., Istanbul (TR)

(72) Inventor: Serkan Akar, Istanbul (TR)

(73) Assignee: AKAR SARACIYE AV MALZEMELERI IMALAT ITHALAT IHRACAT SAN. VE TIC. LTD. STI., Istanbul (TR)

( * ) Notice: Subject to any disclaimer, the term of this patent is extended or adjusted under 35 U.S.C. 154(b) by 0 days.

(21) Appl. No.: 15/880,745

(22) Filed: Jan. 26, 2018

(30) Foreign Application Priority Data

Jan. 22, 2018 (TR) ..... a 2018 00842

(51) Int. Cl.
*F41C 33/02* (2006.01)
*F41C 33/04* (2006.01)

(52) U.S. Cl.
CPC ..... *F41C 33/0263* (2013.01); *F41C 33/0236* (2013.01); *F41C 33/0272* (2013.01); *F41C 33/041* (2013.01)

(58) Field of Classification Search
CPC ..... F41C 33/0263; F41C 33/0272
USPC ..... 224/243, 192, 193, 198, 238
See application file for complete search history.

(56) References Cited

U.S. PATENT DOCUMENTS 6,385,890 B1 * 5/2002 Amadini ..... F41A 17/02 224/243
6,752,300 B2 * 6/2004 Har-Shen ..... F41C 33/0209 224/244
7,530,456 B1 * 5/2009 Tsai ..... F41C 33/0236 206/317
7,841,497 B1 * 11/2010 Gregory ..... F41C 33/045 224/243
8,235,263 B1 * 8/2012 Yeates ..... F41C 33/0263 224/193
8,720,753 B2 * 5/2014 Beneš ..... F41C 33/0236 224/192
8,910,839 B2 * 12/2014 Clifton ..... F41C 33/0209 224/192
9,777,986 B1 10/2017 Lance et al.
2009/0107865 A1 * 4/2009 Tsai ..... F41C 33/0236 206/317
2009/0321480 A1 * 12/2009 Kincaid ..... F41C 33/0227 224/243

(Continued)

*Primary Examiner* — Nathan J Newhouse
*Assistant Examiner* — Lester L Vanterpool
(74) *Attorney, Agent, or Firm* — Kilpatrick Townsend & Stockton LLP

(57) ABSTRACT

The present invention relates to a holster (A) which provides removal of the guns from the holster in an easy and rapid manner used by civil users, security forces, military personnel and army officers and comprising a holster body (1) and at least one lock latch (3) and where the lock latch end (3.1) of said lock latch (3) moves outwardly and separated from the guard and where the gun is released and provides separation from the holster body (1), characterized by comprising a slider (2) assembled on the bearing (1.1) by means of engagement tabs (1.6) in a manner realizing linear movement and having forward backward movement capability in a linear manner on the rail (1.3) by means of at least one spring (4), finger housing (2.1) formed in an integrated manner on the outer surface of the slider (2).

5 Claims, 6 Drawing Sheets

(56) References Cited

U.S. PATENT DOCUMENTS

| | | | | |
|---|---|---|---|---|
| 2011/0101063 | A1* | 5/2011 | Zusman | F41C 33/0227 224/682 |
| 2012/0223110 | A1* | 9/2012 | Gregory | F41C 33/0263 224/193 |
| 2014/0048573 | A1* | 2/2014 | Pellegrini | F41C 33/0227 224/243 |
| 2015/0247701 | A1* | 9/2015 | Faifer | F41C 33/0209 224/244 |
| 2015/0345898 | A1* | 12/2015 | Bardy | F41C 33/0263 224/244 |

* cited by examiner

HOLSTER

This application claims benefit of Serial No. TR 2018/00842, filed 22 Jan. 2018 in Turkey, and which application is incorporated herein by reference. To the extent appropriate, a claim of priority is made to the above disclosed application.

TECHNICAL FIELD

The present invention relates to a holster which provides removal of guns from the holster in an easy and rapid manner used by civil users, security forces, military personnel and army officers.

KNOWN STATE OF THE ART

Holsters are used for carrying and protecting the guns in a secure manner. Said holsters shall have a structure which allows removal of the guns in a rapid and easy manner during use.

As an example to the known state of the art, the patent with title "holster" and with number U.S. Pat. No. 9,777,986 can be given. Said patent document comprises a holster and an accessory configured to be fixed to a mounting rail of a handgun. The holster has a holster body with a pair of opposing wall portions defining a cavity. A stop surface of the holster body engages a forward facing surface of the accessory upon insertion of the handgun with accessory into the holster body thereby providing a seating position of the handgun and accessory in the holster body. The blocking member at least inhibits removal of the handgun and accessory if the handgun and accessory are urged rearwardly before a thumb receiving portion is depressed.

For the use of the holster described in the abovementioned document, the gun is positioned in the holster by means of an accessory connected to the mounting rail of the gun, and there is a release mechanism for removing the gun from the holster.

As another example to the known state of the art, the patent document with number U.S. Pat. No. 7,841,497 and with title "holster retention system" can be given. Said patent document relates to a holster for a handgun, wherein the lever is pivotally attached to a side wall of the holster, along the axis, approximately between the finger button end and the engagement end, such that the finger button end extends into the frame/slide portion of the holster and the engagement end extends into the trigger guard portion of the holster, wherein the lever is pivotable between an engaged position and a disengaged position, and wherein, when the lever is in the engaged position, the locking portion protrudes into a holster cavity, via an opening in the side wall.

In the holster described in the abovementioned document, as a result of the excessive pressure of the locking part on the holster, the locking part may excessively enter into the gun guard and may lead to undesired locking.

As a result, because of the abovementioned problems and the deficiencies of the present solutions, an improvement is required related to holster in the technical field.

OBJECTS OF THE INVENTION

In the light of the known state of the art, the main object of the invention is to obtain a novel holster which provides advantages and which eliminates the disadvantages in the known state of the art.

Another object of the present invention is to provide holding and drawing of the gun in a rapid and correct manner by means of a natural grabbing movement thanks to the sliding mechanism related to release of the gun from the holster.

Another object of the present invention is to provide a fixed force exerted for each lock latch by means of the linearly moving slider and to prevent pushing of the lock latch by the user by means of an unnecessary force.

Another object of the present invention is to prevent undesired locking, which occurs as a result of excessive pressure of the lock latch end onto the lock, as the slider stabilizes the user force.

BRIEF DESCRIPTION OF THE INVENTION

The present invention relates to a holster which provides removal of the guns from the holster in an easy and rapid manner used by civil users, security forces, military personnel and army officers, characterized in that the slider comes back with a linear movement as the user finger, positioned in the housing on the slider, draws the slider back and at the same time, the slider approaches the gun handle and the time duration for coming together of the user's finger, positioned to the housing on the slider, with the other fingers, is reduced when the gun is released and the gun handle is held in a more rapid and stronger manner.

BRIEF DESCRIPTION OF THE FIGURES

The object of the figures whose brief descriptions are given here is only to provide understanding of the present invention and the figures do not have the object of defining the targeted protection scope or of defining the context of this protection scope without taking into consideration the detailed description of the invention.

REFERENCE NUMBERS

Figure 1:
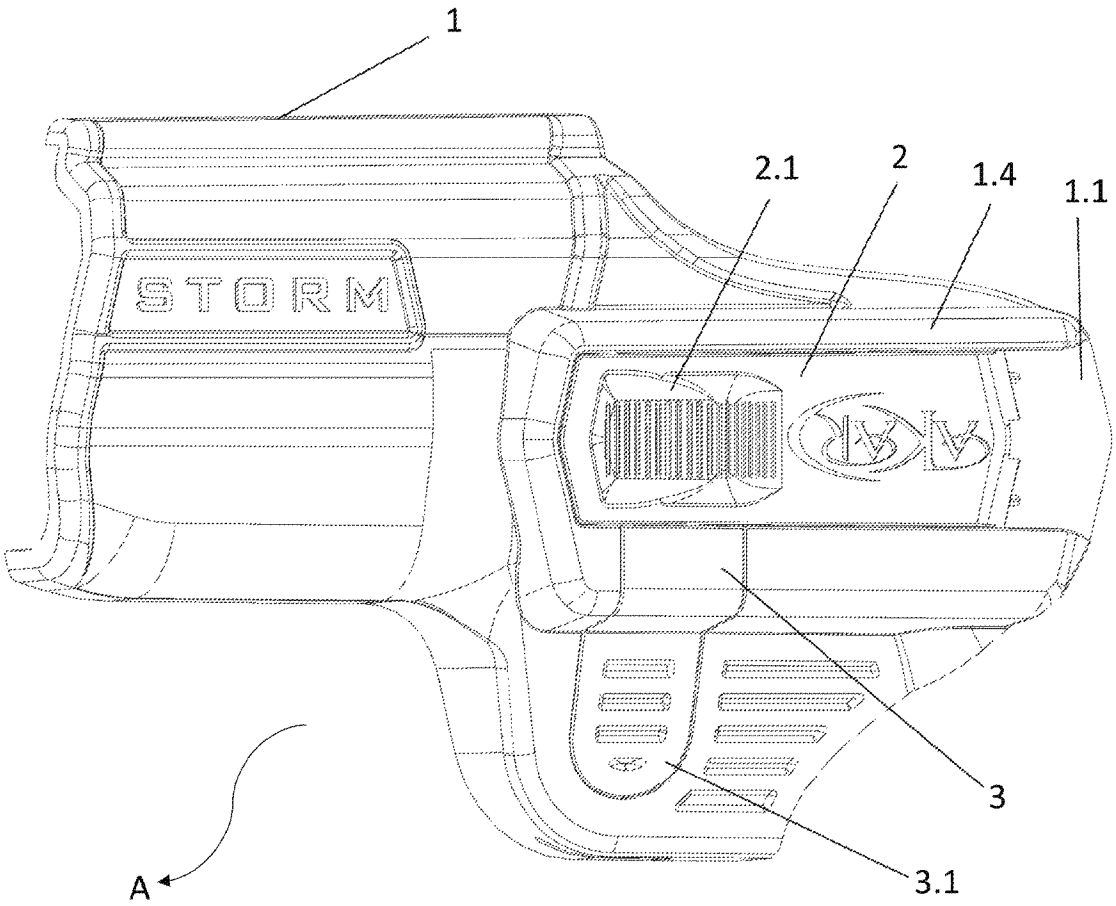
In FIG. 1, the view of the holster in the locked position is given.

NO PART NAME
1 Holster body
1.1 Bearing
1.2 Lock latch housing
1.3 Rail
1.4 Bearing wall
1.5 Pin housing
1.6 Engagement tabs
2 Slider
2.1 Finger housing
2.2 Latch head housing
3 Lock latch
3.1 Lock latch end
3.2 Lock latch head
4 Spring
5 Belt hanging apparatus
6 Auxiliary apparatus
A Holster

DETAILED DESCRIPTION OF THE INVENTION

The present invention relates to a holster (A) which provides removal of the guns from the holster in an easy and rapid manner used by civil users, security forces, military personnel and army officers and comprising a holster body (1) and at least one lock latch (3) and where the lock latch end (3.1) of said lock latch (3) moves outwardly and separated from the guard and where the gun is released and provides separation from the holster body (1), characterized by comprising:

- a bearing (1.1) formed such that the edges are encircled by the bearing walls (1.4) on the right and left outer surfaces of said holster body (1),
- rail (1.3) formed in housing form at the inner section of said bearing wall (1.4),
- a slider (2) assembled on the bearing (1.1) by means of engagement tabs (1.6) in a manner realizing linear movement and having forward backward movement capability in a linear manner on the rail (1.3) by means of at least one spring (4),
- finger housing (2.1) formed in an integrated manner on the outer surface of the slider (2).

On the left and right outer surfaces of the holster body (1), there is a bearing (1.1) which is in recess form and whose edges are encircled by the bearing walls (1.4), and housing-shaped rail (1.3) has been formed at the inner section of said housing wall (1.4) and there is a lock latch housing (1.2) and engagement tabs (1.6) on the bearing (1.1). There is a pin housing (1.5), which is parallel to the axis of the holster body (1), on the inner surface of the lock latch housing (1.2).

On the outer surface of the slider (2), there is a finger housing (2.1) formed in a one-piece and integrated manner with the slider (2). A latch head housing (2.2), having an inwardly curved form, is formed on the inner surface of the slider (2). A spring (4) is positioned to the gap, remaining between the slider (2) and the holster body (1), in a connected manner to the engagement tabs (1.6) of the holster body (1) and the slider (2). Said spring (4) provides the slider (2) to exert forward pushing force on the bearing (1.1). The slider (2) is positioned onto the bearing (1.1), provided on the outer surface of the holster body (1), by means of engagement tabs (1.6). The slider (2) has linear movement capability inside the rail (1.3) formed in housing form at the inner section of the bearing wall (1.4).

The lock latch (3) has a lock latch head (3.2) provided at the upper part and a lock latch end (3.1) which is angled inwardly with respect to said lock latch head (3.2) and provided at the lower part. The lock latch (3) is connected to the lock latch housing (1.2), provided on the bearing (1.1), in a movable manner by means of the pin housing (1.5) which is parallel to the axis of the holster body (1), and the slider (2) is positioned on the lock latch (3). According to the usage of the holster (A) by the user with his right and left hand, the lock latch (3) is positioned at the right or left of the holster body (1) and in the same manner, the slider (2) is positioned to the side where the lock latch (3) is provided.

The belt hanging apparatus (5) is connected to the other outer surface of the holster body (1) by means of the auxiliary apparatus (6) and the holster body (1) is fixed onto the user belt.

Figure 2:
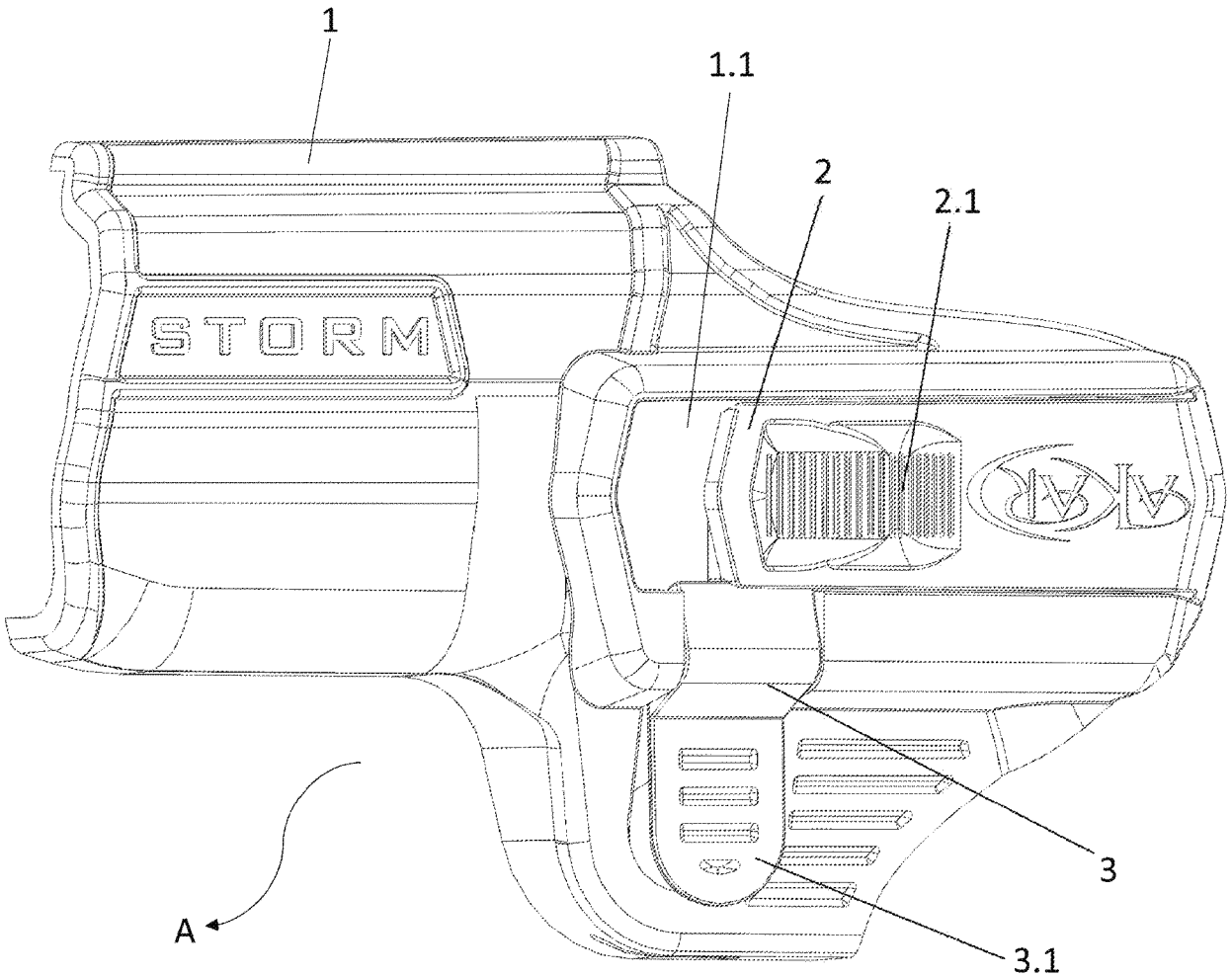
In FIG. 2, the view of the holster in the unlocked position is given.
Figure 3:
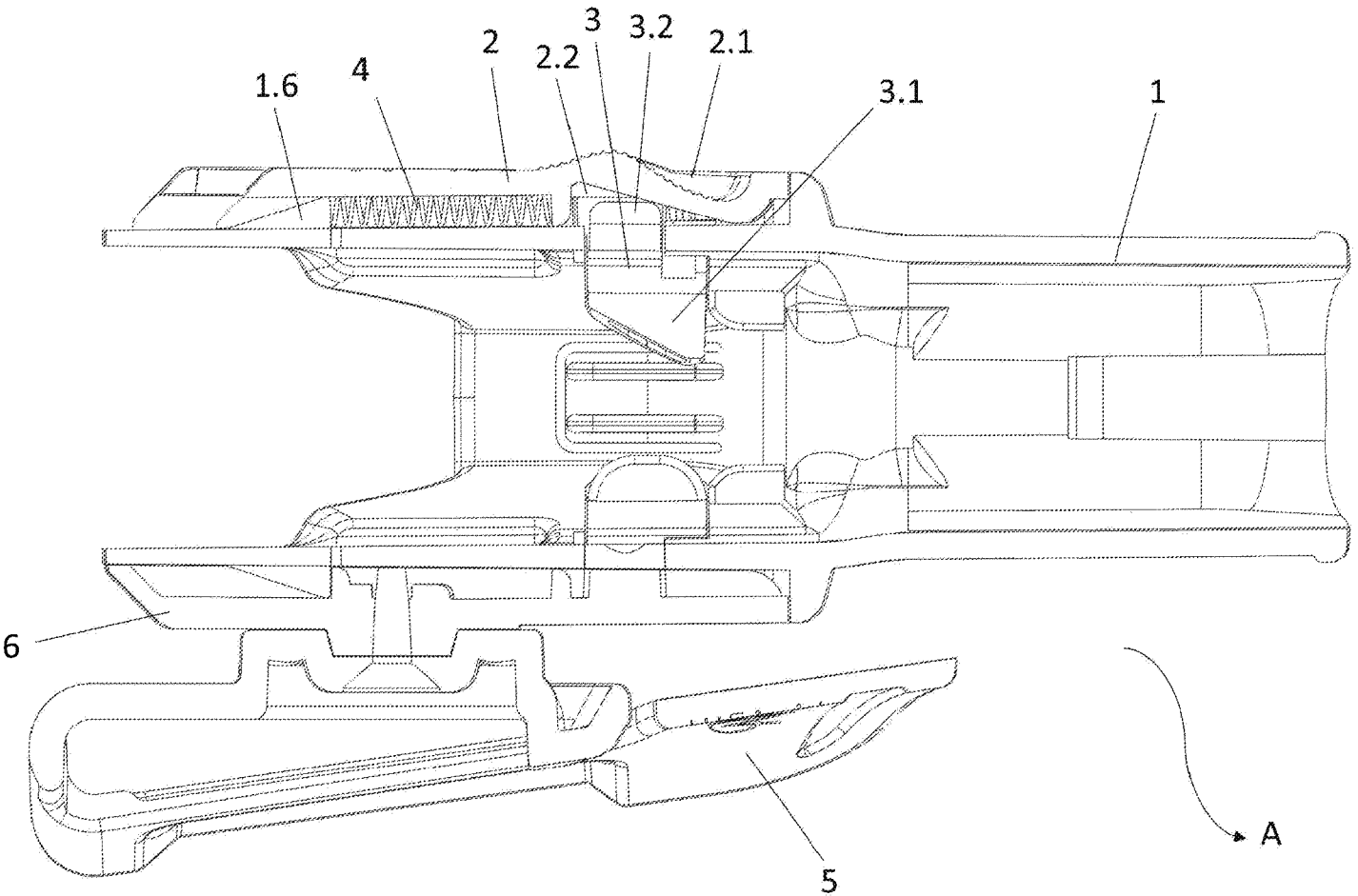
In FIG. 3, the cross sectional view of the holster is given.
Figure 4:
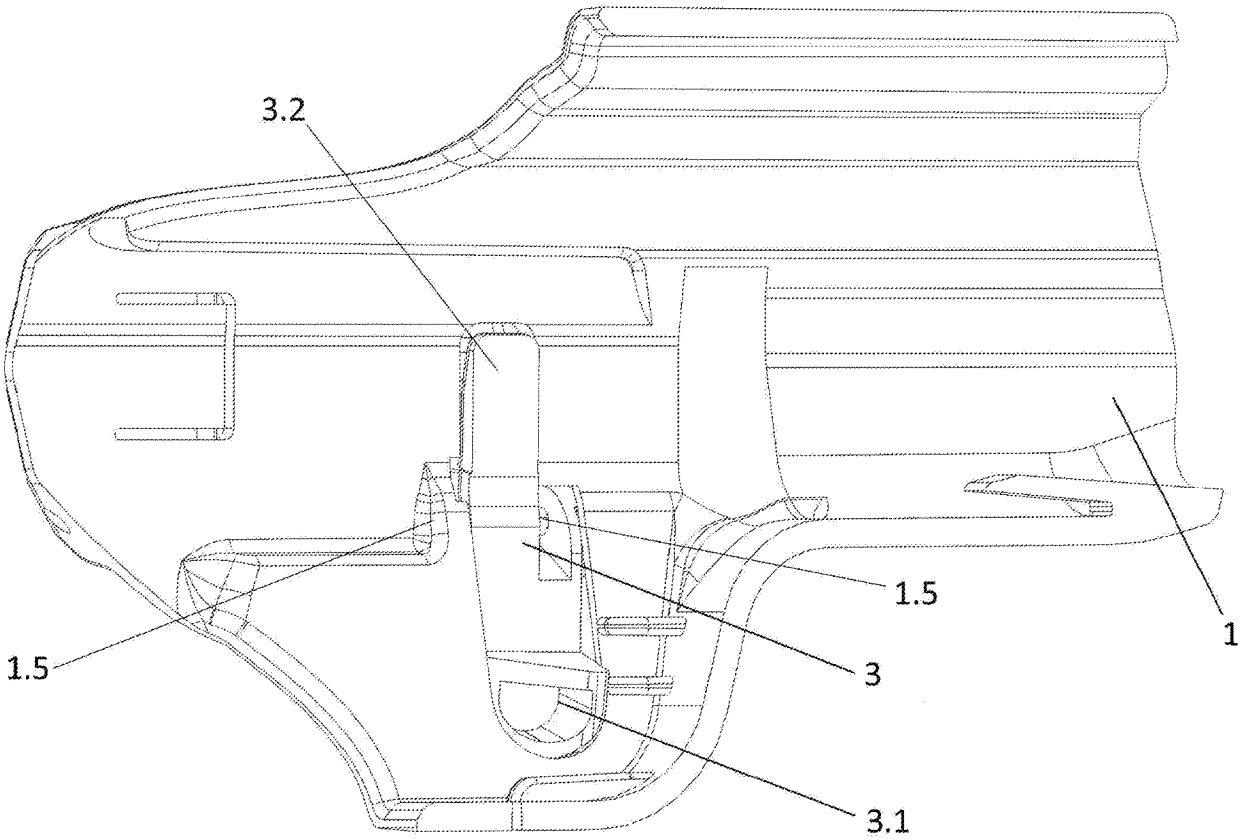
In FIG. 4, the inner view of the holster is given.
Figure 5:
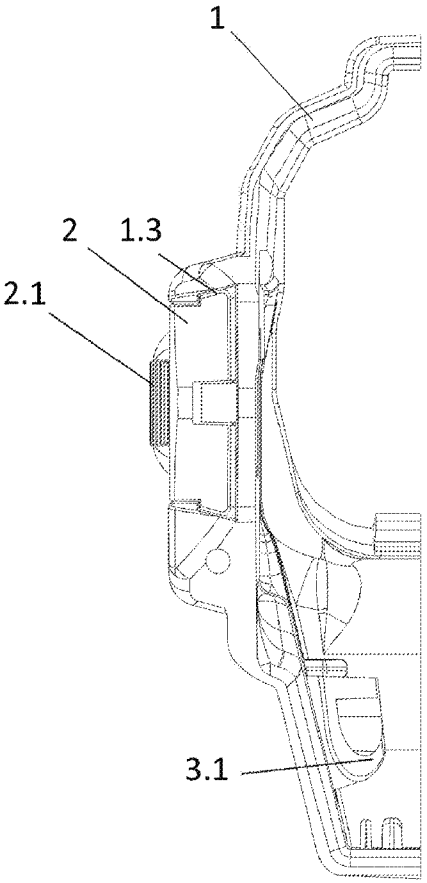
In FIG. 5, the lateral view of the holster is given.
Figure 6:
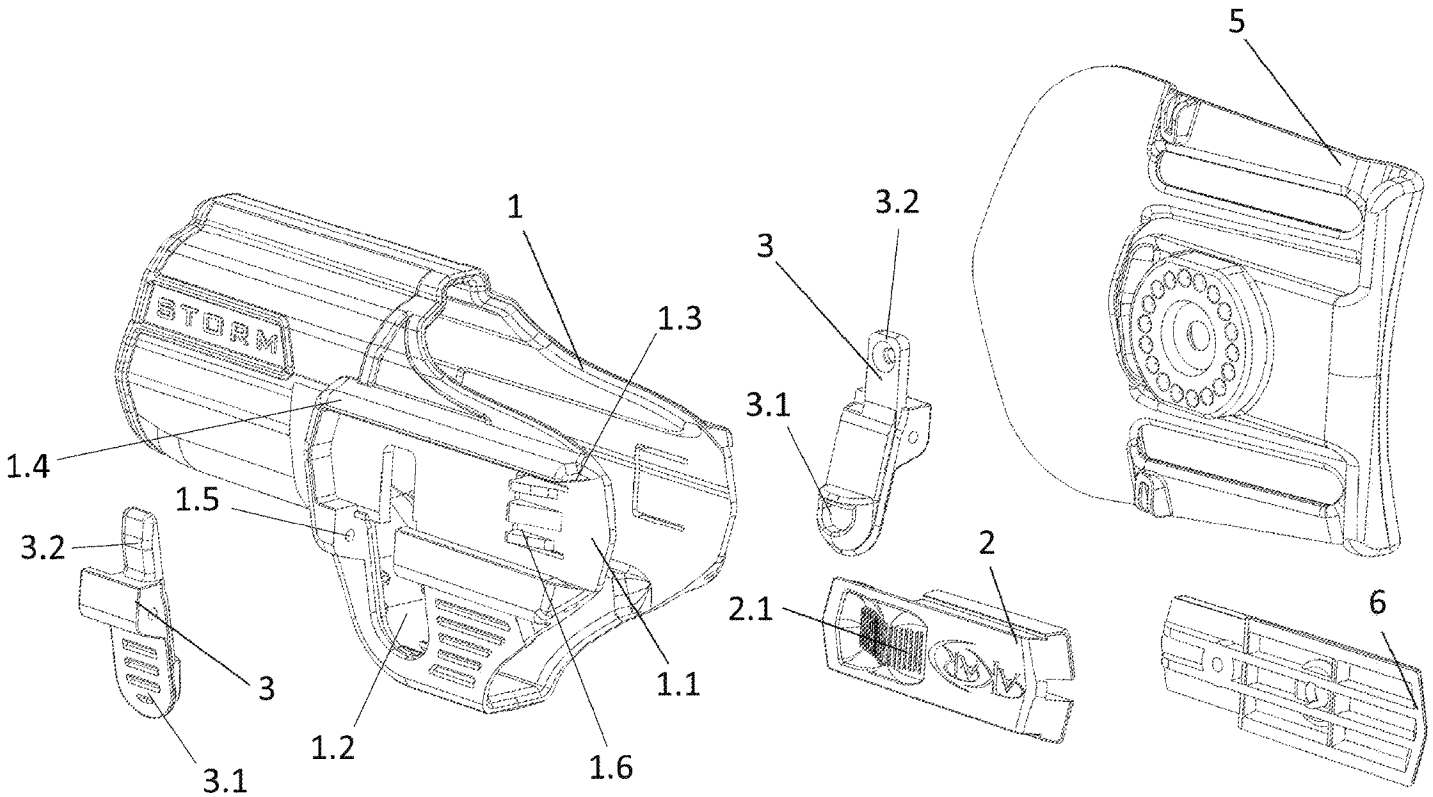
In FIG. 6, the exploded view of the holster is given.

As seen in FIGS. 1 and 2, the operation principle of the holster (A) is as follows;

As seen in FIG. 1, the slider (2) is pushed forwardly on the bearing (1.1) and at the same time, it is continuously locked by means of the spring (4). Meanwhile, since the lock latch end (3.1) and the lock latch head (3.2) of the lock latch (3) have an angled structure with respect to each other, the lock latch end (3.1) is positioned inside the holster body (1) and the lock latch head (3.2) is positioned at the latch head housing (2.2) having inwardly curved structure on the inner surface of the slider (2). As the slider (2) is pulled backwardly by means of the finger housing (2.1), the slider (2) moves inside the rail (1.3) formed in housing form at the inner section of the bearing wall (1.4) and on the bearing (1.1) as seen in FIG. 2. The slider (2) exerts pressure to the lock latch head (3.1) positioned under it by means of this movement, and the lock latch head (3.2) moves towards the inner surface of the holster body (1) inwardly from the lock latch housing (1.2). By means of this, the lock latch end (3.1) moves outwardly and it is separated from the guard and the gun is released and it is separated from the holster body (1). When the gun is released from the holster body (1), the coming together duration of the user's finger, positioned to the finger housing (2.1) on the slider (2), with the other fingers is reduced, and the gun handle is held in a more rapid and stronger manner.

The force exerted on the lock latch head (3) is continuously fixed by means of the slider (2) which moves forwardly backwardly in a linear manner as a result of the effect of the spring (4) inside the bearing (1.1), and locking of the lock latch end (3.1) in an undesired manner as a result of the pushing of the lock latch (3) by the user with an unnecessary force is prevented.

The invention claimed is:

1. A holster which provides removal of a gun from the holster in an easy and rapid manner used by civil users, security forces, military personnel and army officers and comprising a holster body and at least one lock latch and where a lock latch end of said lock latch moves outwardly and separated from a guard and where the gun is released and provides separation of the gun from the holster body characterized by comprising:

- a bearing formed such that edges are encircled by a bearing wall on a right and a left outer surfaces of said holster body,
- a rail formed in housing shape at an inner section of said bearing wall,
- a slider assembled on the bearing by means of engagement tabs in a manner realizing linear movement on an axis parallel to the gun and having forward backward movement capability in a linear manner on the rail by means of at least one spring,
- a finger housing formed in an integrated manner on an outer surface of the slider,
- said lock latch comprises a lock latch head which moves towards an inner surface of the holster body from a lock latch housing by means of exerting pressure thereon by a rearward movement of the slider and provided at a latch head housing, having an inward curved structure, on the inner surface of the slider,
- said lock latch comprises a lock latch end which is separated from the guard by means of moving outwardly by exerting pressure on the lock latch head by means of the rearward movement of the slider and which provides releasing of the gun from the holster body.

2. The holster according to claim 1, wherein on an inner surface of said slider, the latch head housing is provided formed in an inwardly curved form.

3. The holster according to claim 1, wherein said bearing comprises the lock latch housing wherein the lock latch is positioned.

4. The holster according to claim 1, wherein a spring is positioned between the slider and the holster body and connected to the engagement tabs of the holster body and the slider in a manner providing forward-backward movement of the slider on the rail in a linear manner.

5. The holster according to claim 1, wherein force exerted on the lock latch head by means of the slider moving forwardly backwardly in a linear manner as a result of a spring inside the bearing is fixed.

* * * * *